US005181723A

United States Patent [19]

Brown

[11] Patent Number: 5,181,723

[45] Date of Patent: Jan. 26, 1993

[54] GOLF PRACTICE DEVICE

[76] Inventor: Russell M. Brown, 57 Washington St., Natick, Mass. 01760

[21] Appl. No.: 846,116

[22] Filed: Mar. 5, 1992

[51] Int. Cl.[5] ..... A63B 69/36

[52] U.S. Cl. ..... 273/186.5; 273/187.3; 273/DIG. 30

[58] Field of Search ..... 273/186 E, 186 A, 186 B, 273/186 C, 186 R, 183 C, 194 R, 194 A, 194 B, DIG. 30

[56] References Cited

U.S. PATENT DOCUMENTS

| | | | |
|---|---|---|---|
| 3,401,941 | 9/1968 | Hesidence | 273/194 A X |
| 4,960,280 | 10/1990 | Corder | 273/DIG. 30 |
| 5,121,924 | 6/1992 | Reed | 273/186 E |

*Primary Examiner*—George J. Marlo
*Attorney, Agent, or Firm*—John E. Toupal; Harold G. Jarcho

[57] ABSTRACT

A golf practice apparatus including a golf club including an elongated shaft, a head portion defining an object striking face, and a hosel portion joining the head portion to one end of the shaft portion; and an accessory for removable attachment to the golf club, the accessory including an elongated band having front and back surfaces, each having middle and first and second end portions; a face cover secured to the middle portion of the front surface between the first and second end portions, the face cover formed from a first material adapted to releasably engage a complementary second material; a first fastener secured to the first end portion of the back surface, the first fastener formed from a third material adapted to releasably engage a complementary fourth material; a second fastener secured to the second end portion of the front surface, the second fastener formed from a fifth material adapted to releasably engage a complementary sixth material and the third fastener secured to the second end portion of the back surface, the third fastener formed from the sixth material.

18 Claims, 2 Drawing Sheets

GOLF PRACTICE DEVICE

BACKGROUND OF THE INVENTION

This invention relates generally to a golf practice device and, more particularly, to a golf practice device for indicating whether a golfer is making an inside/out swing or an outside/in swing when addressing a golf ball.

After being struck by a golf club, both the accuracy and distance of flight experienced by a golf ball is highly influenced by the orientation of the club head during impact. Accuracy and distance of ball flight are enhanced by a golf swing in which upon impact with a ball a club head is moving on an inside/out path with respect to a target line; i.e. an imaginary line between the ball and the pin objective. Such a swing generates for the struck ball a right to left overspin that brings the struck ball back onto the target line as the ball spins through the air. In addition, the overspin enables the ball to cut through the air in a manner that both lengthens flight and the roll experienced after the ball reaches the ground.

Many golf practice devices have been disclosed for indicating the manner in which a simulated golf ball is struck by the face of a golf club. Examples of such devices are disclosed in U.S. Pat. Nos. 3,401,941; 3,721,447; 3,870,316; 4,149,726; and U.S. Pat. No. 4,826,173. Each of these patents discloses a system in which a simulated golf ball adheres to an adhesive textile insert applied to the face of the golf club. However, the systems disclosed in each of these patents indicates only the position on a club face that is impacted by a struck ball. The precise location of club face impact fails to indicate the direction in which the golf club head is moving at the time of impact. None of the disclosed patents discloses a technique for analyzing swing direction by indicating the relative position on a golf ball that is impacted by the face of a golf club.

The object of this invention, therefore, is to provide an improved golf practice device that will indicate the direction of movement experienced by the head of a golf club as it impacts a simulated golf ball.

SUMMARY OF THE INVENTION

The invention is a golf practice apparatus including a golf club including an elongated shaft, a head portion defining an object striking face, and a hosel portion joining the head portion to one end of the shaft portion; and an accessory for removable attachment to the golf club, the accessory including an elongated band having front and back surfaces, each having middle and first and second end portions; a face cover secured to the middle portion of the front surface between the first and second end portions, the face cover formed from a first material adapted to releasably engage a complementary second material; a first fastener secured to the first end portion of the back surface, the first fastener formed from a third material adapted to releasably engage a complementary fourth material; a second fastener secured to the second end portion of the front surface, the second fastener formed from a fifth material adapted to releasably engage a complementary sixth material and the third fastener secured to the second end portion of the back surface, the third fastener formed from the sixth material.

According to certain features, the invention further includes a hollow cylinder adapted to be positioned on a flat surface and struck by the golf club, the cylinder when positioned on the flat surface defining distinguishable, right and left intersecting areas projecting from each other in a direction parallel to the flat surface, and wherein the right and left areas are covered with the second material.

According to other features of the invention, the right area is defined by a first fabric strip, the left area is defined by a second fabric strip, and opposite ends of the first and second fabric strips are joined together to form the hollow cylinder.

According to another feature of the invention, the elongated band is formed from an elastic material. The elongated elastic band simplifies stable mounting of accessory over the club face.

According to still other features of the invention, the third material and the sixth material are the same; each of the face cover, the first fastener, the second fastener, and the third fastener are fabric pads secured by stitching to the elongated band; and each of the second and third fasteners comprise fabric pads of substantially greater length than the first fastener fabric pad. This configuration further facilitates assembly of the accessory on the golf club.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
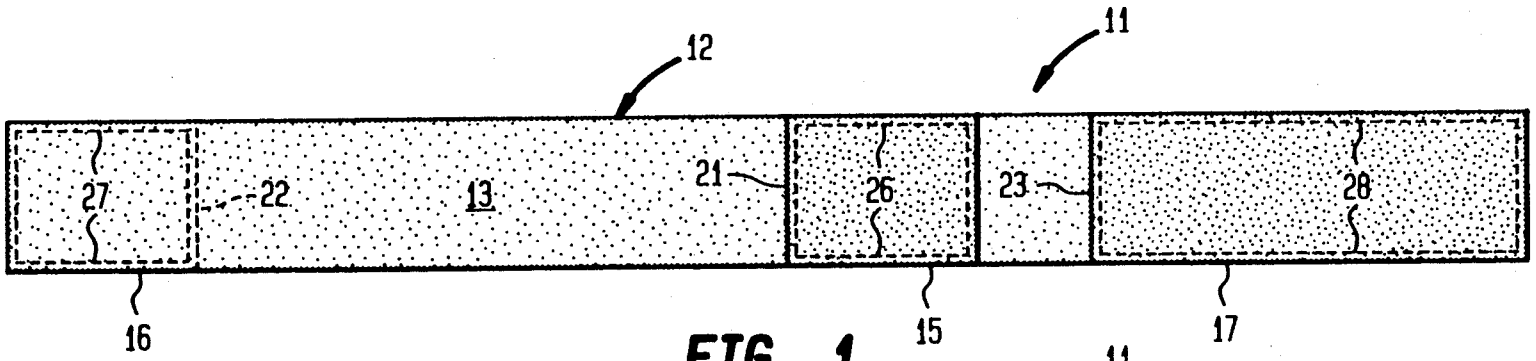
FIG. 1 is a plan view of a golf club accessory according to the invention.

A golf club accessory 11 includes an elongated elastic band 12 having a front surface 13, a back surface 14, a middle portion 15, a first end portion 16 and a second end portion 17. Also included in the accessory 11 are a face cover 21 secured to the middle portion 15 of the front surface 13, a first fastener 22 secured to the first end portion 16 of the back surface 14, a second fastener 23 secured to the second end portion of the front surface 13 and third fastener 24 secured to the second end portion 17 of the back surface 14.

The face cover 21, the first fastener 22, the second fastener 23 and the third fastener 24 each comprises a fabric pad formed of a material adapted to releasably engage a complementary material. Preferably the elongated band 12 is formed of a rubberized elastic material and the face cover 21, the first fastener 22, the second fastener 23 and the fourth fastener 24 are secured thereto by, respectively, stitching 26, 27, and 28. The face cover 21 is formed from a first material engageable with a compatible second material used for the surface of a simulated puck 31 shown in FIG. 4; the first fastener 22 is formed from a third material engageable with a compatible material used for one of either the second fastener 23 or the third fastener 24; and the second fastener 23 is formed from a fifth material engageable with a compatible sixth material used to form the third fastener 24. In a preferred embodiment of the invention, the first fastener 22 and the third fastener 24 are formed of the hook type textile material manufactured under the trademark "Velcro" while the fastener 23 is formed of the compatible loop textile material of that type.

Figure 2:
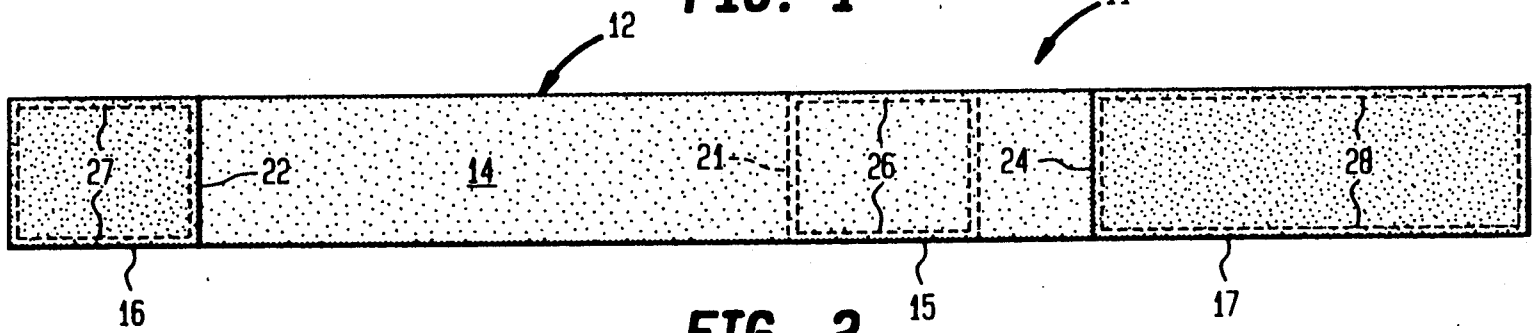
FIG. 2 is a rear view of the accessory shown in FIG. 1.
Figure 3:
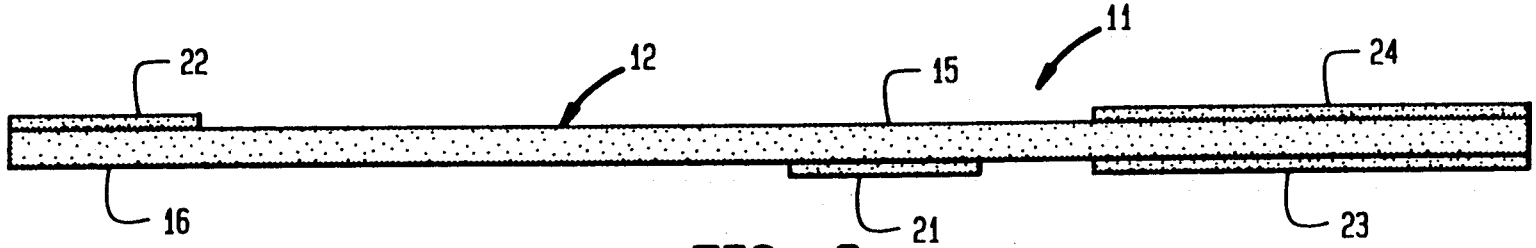
FIG. 3 is a top view of the accessory shown in FIGS. 1 and 2.
Figure 4:
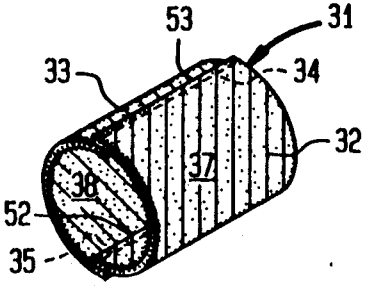
FIG. 4 is a perspective view of a simulated golf ball for use with the accessory shown in FIGS. 1-3.

As shown in FIG. 4, the simulated golf ball 31 is a hollow cylinder having one half formed by a first fabric strip 32 and a diametrically opposed second half formed by a second fabric strip 33. Opposite ends of the first and second fabric strips 32, 33 are joined, for example, by stitching 34, 35. Preferably, the first outer surface of the first fabric strip 32 defines a right area while the outer surface of the second fabric strip 33 defines a left area 38. Both the right and left areas 37, 38 are covered with a material engageable with the face cover 21 (FIGS. 1-3). Preferably the face cover 21 is formed of loop type "Velcro" material and the ball is formed of hook type "Velcro" material. Use of loop material for the cover 21 minimizes undesirable engagement thereof with foreign material such as loose grass. The right and left areas 37, 38, respectively, are made visually distinguishable by for example dying the outer surfaces of the first and second fabric strips 32, 33 different colors. Although FIG. 4 illustrates the areas 37, 38 as red and green, it will be obvious that other distinguishable colors could be used.

OPERATION

Figure 7:
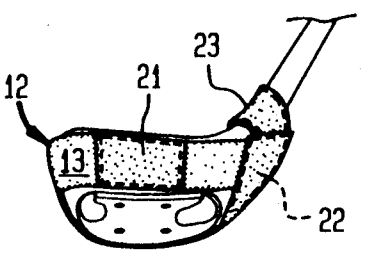
FIGS. 5-7 are schematic views illustrating the manner in which the accessory of FIGS. 1-3 is attached to a golf club.
Figure 6:
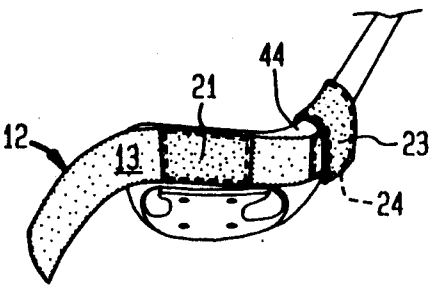
Figure 5:
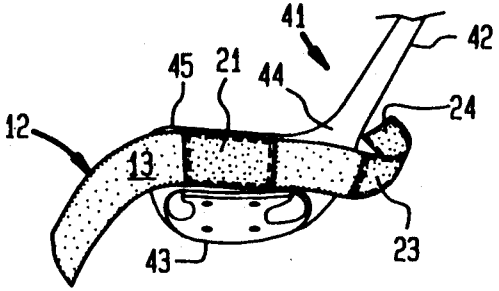

Prior to use, the accessory 11 is secured to a conventional golf driver in which one end of an elongated shaft 42 is secured to a head portion 43 by a hosel portion 44 in the manner illustrated in FIGS. 5-7. The face cover 21 is positioned facing outwardly and directly over an object striking face 45 on the head portion 43 of the golf club 41 (FIG. 5). Next, the second end portion 17 of the band 12 is wrapped around the hosel portion 44 of the golf club 41 and the third fastener 24 secured to the compatibly engageable second fastener 23 (FIG. 6). Finally, the first end portion 16 is wrapped around the toe and heel portions of the head portion 43, and the first fastener 22 is secured to the engageably compatible second fastener 23 (FIG. 7).

Figure 8:
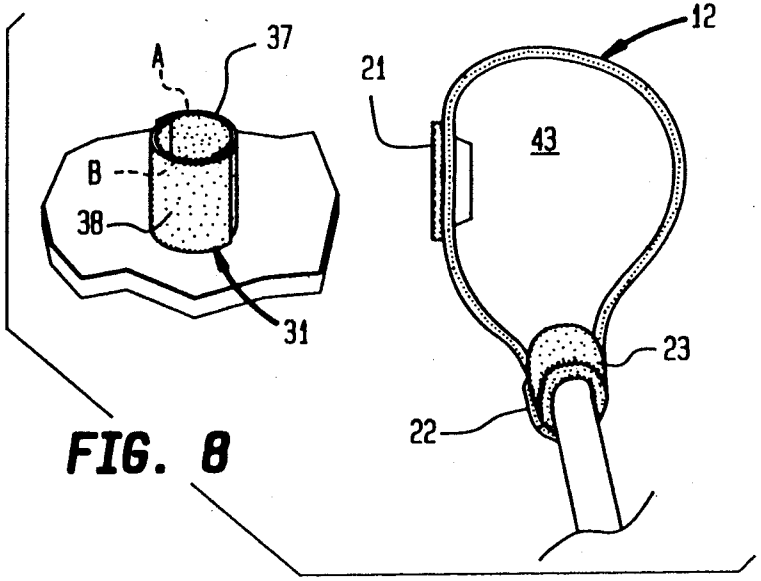
FIG. 8 is a schematic view of a simulated golf ball of FIG. 4 being approached by a golf club head retaining the accessory of FIGS. 1-3.

After securing the accessory 11 to the golf club 41 as shown in FIGS. 5-7, the simulated puck 31 is positioned on a flat surface 51 with its access perpendicular thereto as shown in FIG. 8. The positioning of the simulated puck 31 is such that the vertically oriented joints 52, 53 between the first and second fabric strips 32, 33 are aligned with the flag on a remote green being approached.

Next, the golfer addresses the simulated puck 31 and takes a practice swing causing contact thereof with the face cover 21 on the head portion 43 of the golf club 41. Because of the compatibly engageable materials employed, the simulated puck 31 becomes releaseably secured to the face cover 21 of the accessory 11. The golfer than examines the club 41 to determine whether the face cover 21 is engaged to the right area 37 or the left area 38 of the simulated puck 31. Assuming a right handed golfer, engagement of the face cover 21 with the left area 38 indicates a desirable inside/out directed golf swing as illustrated by the dotted dashed line A of FIG. 8. Conversely, engagement of the face cover 21 with the right area 37 of a simulated puck 31 indicates an undesirable outside/in swing represented by the dashed lines b in FIG. 8. Thus, by using the accessory 11 and simulated puck 31, prior to actually teeing off, a golfer can gain assurance that a proper inside/out swing is being employed.

Obviously, many modifications and variations of the present invention are possible in light of the above teachings. It is to be understood, therefore, that the invention can be practiced otherwise than as specifically described.

What is claimed is:

1. Golf practice apparatus for use with a golf club including an elongated shaft, a head portion defining a toe portion an object striking face, and a hosel portion joining said head portion to one end of said shaft; said apparatus comprising:

an accessory adapted to be removably attached to said golf club, said accessory comprising an elongated band having front and back surfaces, each having middle and first and second end portions; a face cover secured to said middle portion of said front surface between said first and second end portions, said face cover formed from a first material adapted to releasably interlock with a complementary second material on a simulated gold ball object struck thereby; first fastener means secured to said first end portion of said back surface, said first fastener means formed from a third material adapted to releasably interlock with a complementary fourth material; second fastener means secured to said second end portion of said front surface, said second fastener means formed from a fifth material adapted to releasably interlock with a complementary sixth material; and third fastener means secured to said second end portion of said back surface, said third fastener means formed from said sixth material, and said fourth material formed from said fifth or sixth material, the structural characteristics of said elongated band being such that said band is adapted to extend from it second end portion at said hosel portion where said fifth and sixth materials are interlocked around said hosel portion, across said striking face, around said toe portion, and back to its first end portion where said third material is interlocked with said fifth or sixth material, and said face cover overlies said striking face.

2. An apparatus according to claim 1 including an object adapted to be positioned on a flat surface and struck by said golf club, said object when positioned on the flat surface defining distinguishable right and left intersecting area projecting from each other in a direction parallel to the flat surface, and wherein said right and left areas are covered with said second material.

3. An apparatus according to claim 2 wherein said object comprises a hollow cylinder having an outer surface formed by diametrically opposed first and second halves wherein said right area is defined by said first half and said left area is defined by said second half.

4. An apparatus according to claim 3 wherein said first half comprises a first fabric strip defining said right area, said second half comprises a second fabric strip defining said left area, and wherein opposite ends of said first and second fabric strips are joined together to form said hollow cylinder.

5. An apparatus according to claim 4 wherein said first area is one color and said second area is another color distinguishable from said one color.

6. An apparatus according to claim 2 wherein said first material is a loop textile material and said second material is a hook textile material.

7. An apparatus according to claim 1 wherein said elongated band is formed from an elastic material.

8. An apparatus according to claim 7 wherein said third material and said sixth material are the same.

9. An apparatus according to claim 8 wherein each of said face cover, said first fastener means, said second fastener means, and said third fastener means are fabric pads.

10. An apparatus according to claim 9 wherein each of said fabric pads is secured by stitching to said elongated band.

11. An apparatus according to claim 10 including an object adapted to be positioned on a flat surface and struck by said golf club, said object when positioned on the flat surface defining distinguishable right and left intersecting areas projecting from each other in a direction parallel to the flat surface, and wherein said right and left areas are covered with said second material.

12. An apparatus according to claim 11 wherein said object comprises a hollow cylinder having an outer surface formed by diametrically opposed first and second halves wherein said right area is defined by said first half and said left area is defined by said second half.

13. An apparatus according to claim 12 wherein said first half comprises a first fabric strip defining said right area, said second half comprises a second fabric strip defining said left area, and wherein opposite ends of said first and second fabric strips are joined together to form said hollow cylinder.

14. An apparatus according to claim 13 wherein said first area is one color and said second area is another color distinguishable from said one color.

15. An apparatus according to claim 9 wherein each of said fabric pads is composed of either hook or loop textile material.

16. An apparatus according to claim 15 wherein said first fastener means, and said third fastener means comprise hook textile material; and said second fastener means and said face cover comprise loop textile material., 17. An apparatus according to claim 16 wherein each of said second and third fastener means comprise fabric pads of substantially greater length than said first fastener fabric pad.

18. An apparatus according to claim 17 wherein each of said fabric pads is secured by stitching to said elongated band.

* * * * *